United States Patent [19]

Mahan

[11] Patent Number: 4,510,361

[45] **Date of Patent: * Apr. 9, 1985**

[54] HORIZONTAL AXIS TUMBLER TYPE MICROWAVE DRYING MECHANISM

[76] Inventor: Douglas P. Mahan, 4300 SW. 188th, Aloha, Oreg. 97007

[ * ] Notice: The portion of the term of this patent subsequent to Jun. 8, 1999 has been disclaimed.

[21] Appl. No.: 374,508

[22] Filed: May 3, 1982

[51] Int. Cl.[3] ..... H05B 6/78

[52] U.S. Cl. ..... 219/10.55 A; 219/10.55 B; 219/10.55 R; 34/1

[58] Field of Search ..... 219/10.55 A, 10.55 R, 219/10.55 B, 10.55 F, 10.55 D; 34/1, 135, 136, 137

[56] References Cited

U.S. PATENT DOCUMENTS

| | | | |
|---|---|---|---|
| 2,273,904 | 2/1942 | Smith | 219/518 |
| 3,410,116 | 11/1968 | Levinson | 219/10.55 R X |
| 3,439,431 | 4/1969 | Heidtmann | 219/10.55 B X |
| 3,461,401 | 8/1969 | Williams | 219/10.55 B X |
| 3,470,942 | 10/1969 | Fukada et al. | 219/10.55 B |
| 3,496,500 | 2/1970 | Romary . | |
| 3,529,115 | 9/1970 | Jawor | 219/10.55 A |
| 3,605,272 | 9/1971 | Boucher | 219/10.55 A X |
| 3,627,959 | 12/1971 | Chapell | 219/10.55 C X |
| 3,678,238 | 7/1972 | Yasuoka et al. | 219/10.55 D |
| 3,789,179 | 1/1974 | Haagensen | 219/10.55 F |
| 3,936,622 | 2/1976 | McElroy . | |
| 4,009,359 | 2/1977 | Tallmadge | 219/10.55 B |
| 4,087,921 | 5/1978 | Blok | 34/1 |
| 4,091,252 | 5/1978 | Koinuma | 219/10.55 R |
| 4,097,707 | 6/1978 | Kobayashi | 219/10.55 B |
| 4,107,501 | 8/1978 | Ironfield | 219/10.55 B |
| 4,131,779 | 12/1978 | Tatsukawa et al. | 219/10.55 R |
| 4,207,452 | 6/1980 | Arai | 219/10.55 R |
| 4,210,795 | 7/1980 | Lentz | 219/10.55 B |
| 4,334,136 | 6/1982 | Mahan | 219/10.55 A |
| 4,356,640 | 11/1982 | Jansson | 34/1 |

*Primary Examiner*—Philip H. Leung

[57] ABSTRACT

A hollow tumbler-type microwave opaque drum is mounted on the horizontal axis in a housing and is driven rotatably for tumbling articles laterally across the interior of the drum. A microwave power unit is disposed with the output thereof directed axially through the rear of the drum for engaging articles tumbling in the drum. The microwave unit is disposed in an auxiliary housing and an arrangement such that a blower can circulate air around the power unit for cooling it and also for moving such air through the cavity of the drum for carrying away vapor which has been removed from the articles. In a second embodiment of the invention, the rear mount power unit can be used in combination with a front mount power unit to double the capacity for removing mositure from articles tumbling in the drum. The front mount power unit also is associated with a passageway arrangement for cooling the power unit.

4 Claims, 4 Drawing Figures

HORIZONTAL AXIS TUMBLER TYPE MICROWAVE DRYING MECHANISM

BACKGROUND OF THE INVENTION

This invention relates to a new and useful improvement in microwave treating mechanisms.

Microwave treating mechanisms have heretofore been conceived one of which is shown in my U.S. Pat. No. 4,334,136 . Such mechanism comprises a horizontal axis tumbler-type drum in a housing arranged to receive articles from which moisture is to be removed. The drum has rear bearing support and a front door through which articles are loaded into and unloaded from the drum. Microwave power means in this prior mechanism, such as magnetron, is mounted in the door and has its output directed axially into the drum. Forced air means are provided for moving air past the power means and through the cavity of the drum whereby forced air that removes moisture from the drum cools the power means and the power means in being cooled causes the forced air to be heated before its entry into the drum to increase the vapor carrying capabilities of the forced air.

SUMMARY OF THE INVENTION

According to the present invention and forming a primary objective thereof, an improved microwave treating mechanism is provided wherein the power means in one embodiment is placed at the rear of a horizontal axis tumbler-type drum.

Furthermore, it is an object of the invention to provide such rear disposition of the power means in combination with power means also provided at the front, such as in the door as in my previous structure.

Another object of the invention is to provide a structure of the type described which employs a novel rear bearing drum mount and support means for the microwave power and also forced air passageway means for cooling the power means in an arrangement such that the forced air that removes moisture from the drum cools the power means and the power means in being cooled causes the forced air to be heated before its entry into the drum to increase the vapor carrying capabilities of the forced air.

In carrying out the objectives of the invention, a hollow tumbler-type microwave opaque drum having an inner cavity and arranged to receive articles from which moisture is to be removed is supported on a horizontal axis in a suitable housing. Microwave power means is disposed with the output thereof extending axially into the rear of the drum into the cavity for applying its radiation energy to articles tumbling laterally across the rotating drum for removing moisture from the articles. A rear hub is disposed between the drum and the housing to provide bearing support for the drum. The rear wall of the drum has an opening and the hub has an axial bore communicating with such opening. The power means is directed through the axial bore and said opening for drying articles in the drum. Passageway means are provided in association with the power means for cooling such power means and for removing moisture laden air from the drum. The front of the drum is closed by a door which according to the invention can also support power means. The door in turn has suitable passageways for cooling the power means by the forced air means.

The invention will be better understood and additional objects and advantages will become apparent from the following description taken in connection with the accompanying drawings.

DETAILED DESCRIPTION OF PREFERRED EMBODIMENTS

Figure 1:
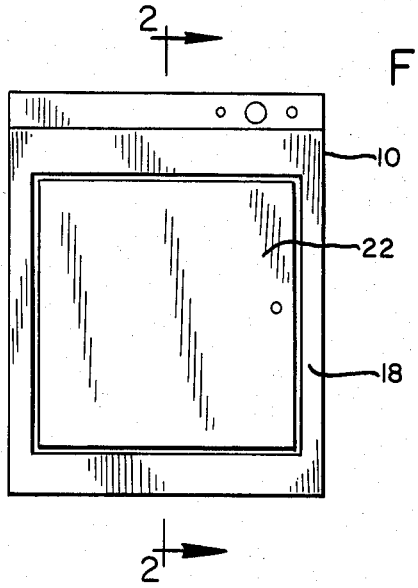
FIG. 1 is a front view of a dryer mechanism in which the present invention is incorporated.
Figure 2:
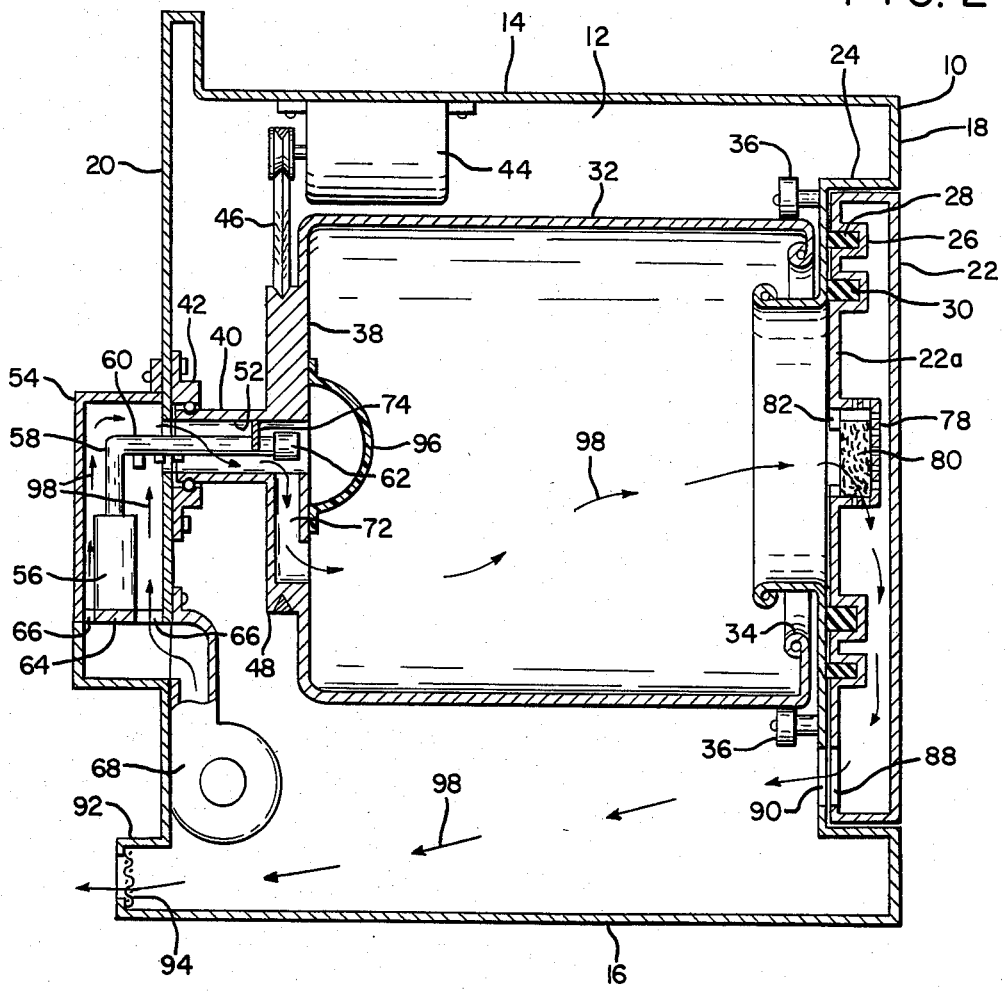
FIG. 2 is a sectional view taken on the line 2—2 of FIG. 1.

With reference first to FIGS. 1 and 2, the numeral 10 designates a conventional clothes dryer-type housing or cabinet having side walls 12, a top wall 14, a bottom wall 16, a front wall 18 and a rear wall 20. A hinged door 22 has recessed support in the front wall 18.

The door recess is partly defined by an insert wall 24 in the front wall 18 of the housing 10. Door 22 comprises a hollow housing structure and has a rear wall **22*a* provided with annular recesses 26 for receiving a rubber gasket 28 which provides a tight seal between the housing and the door and an RF gasket 30 which serves to prevent the outflow of microwave energy between wall 24 and panel 22*a***.

A tumbler-type drum 32 is disposed within the housing 10 and has a front opening 34 communicating with the door opening at the front of the housing. Drum 32 has front rotative support on a plurality of bearing mounted rollers 36 on the housing. The drum has a rear wall 38 and an integral rearwardly extending hub 40. The rear of hub 40 has bearing support 42 on the rear wall 20 of the housing. The drum is driven by an electric motor 44 mounted on the housing 10 and having a belt drive 46 with a pulley 48 integral with the rear wall 38 of the drum. A bore 52 opens through the drum wall 38 as well as through the hub 40 and communicates at the rear with an auxiliary housing 54 enclosing microwave power means 56 such as magnetron having a directional coupler portion 58, a tuner portion 60, and an output or wave guide portion 62. Housing 54 has cross webs 64 for supporting the microwave power means 56 and extends therebelow for communication, through openings 66, with a blower 68 mounted in the housing 14 such as on the rear wall.

Importantly, the auxiliary housing 54 is somewhat larger than the power means and the latter is mounted in spaced relation from the walls thereof so that forced air from the blower 68 will encircle it. Likewise, the bore 52 is of larger diameter than the diameter of the portions of the power means enclosed therein whereby forced air can also flow around these portions. The rear wall 38 of the drum has one or more radial passageways 72 which communicate with the bore 52 and which open into the drum whereby forced air which flows past the power means will exit into the drum. It is preferred that the forced air be deflected away from the output end 62 of the power means so as not to flow directly thereover, and for this purpose a baffle 74 is provided over the top and partly down the sides of the power means adjacent the output 62 whereby the forced air is deflected downwardly to mostly flow out through passageway 72 rather than blowing across the end of the output 62.

The rear wall 22*a* of the door 22 has a perforated pocket 78 arranged to hold a lint basket 80 removably therein. Pocket 78 has top and bottom projections 82 and dimensioned so that the lint basket can be freely dropped into place and also easily removed. Such lint screen preferably is of a suitable material and mesh so as to filter loose particles from the articles being treated in the drum and also to filter microwave energy to prevent escape through this portion of the door. Such lint basket is constructed of metal of selected mesh to provide the combined filtering function. An opening 88 is provided adjacent the bottom of rear wall 22*a*, and this opening communicates with an opening 90 in the inset wall 24 of the housing. The rear wall 20 of the housing adjacent the bottom has an outlet 92 covered with a removable screen 94 which similar to the lint basket 80 may be of selected mesh to filter particles from the articles being treated as well as to filter leakage of microwave energy from the drum.

A dome-like shield 96 of microwave transparent meterial is secured on the inner surface of rear wall 38 of the drum. Such shield is mounted over the end of the output 62 to protect the end of the output 62 physically from tumbling articles in the drum. It also serves to space tumbling articles from such coupler so as to keep objects a minimum wave length distance away from the coupler and thus out of the coupler's near field. Such prevents perturbations of the near field by articles in the dryer from providing increases in the average reflected power or voltage standing wave ratio which may be damaging to the microwave power means.

According to the invention thus far described, microwave power is admitted through the rear of the drum to provide a simplified dryer structure and arrangement. Such rear power means does not interfere in any manner with loading and unloading of the drum and the electrical circuitry thereto can be simplified in its arrangement. Blower 68 circulates air in the pattern shown by arrows 98 in FIG. 2. This cools the magnetron and other associated parts, and such air, in view of its being heated by the magnetron and thus having increased vapor carrying capabilities, assists in removing moisture from the articles being treated. Such moving air discharges through lint basket 80, down the door through openings 88 and 90, and out the outlet 92.

Figure 3:
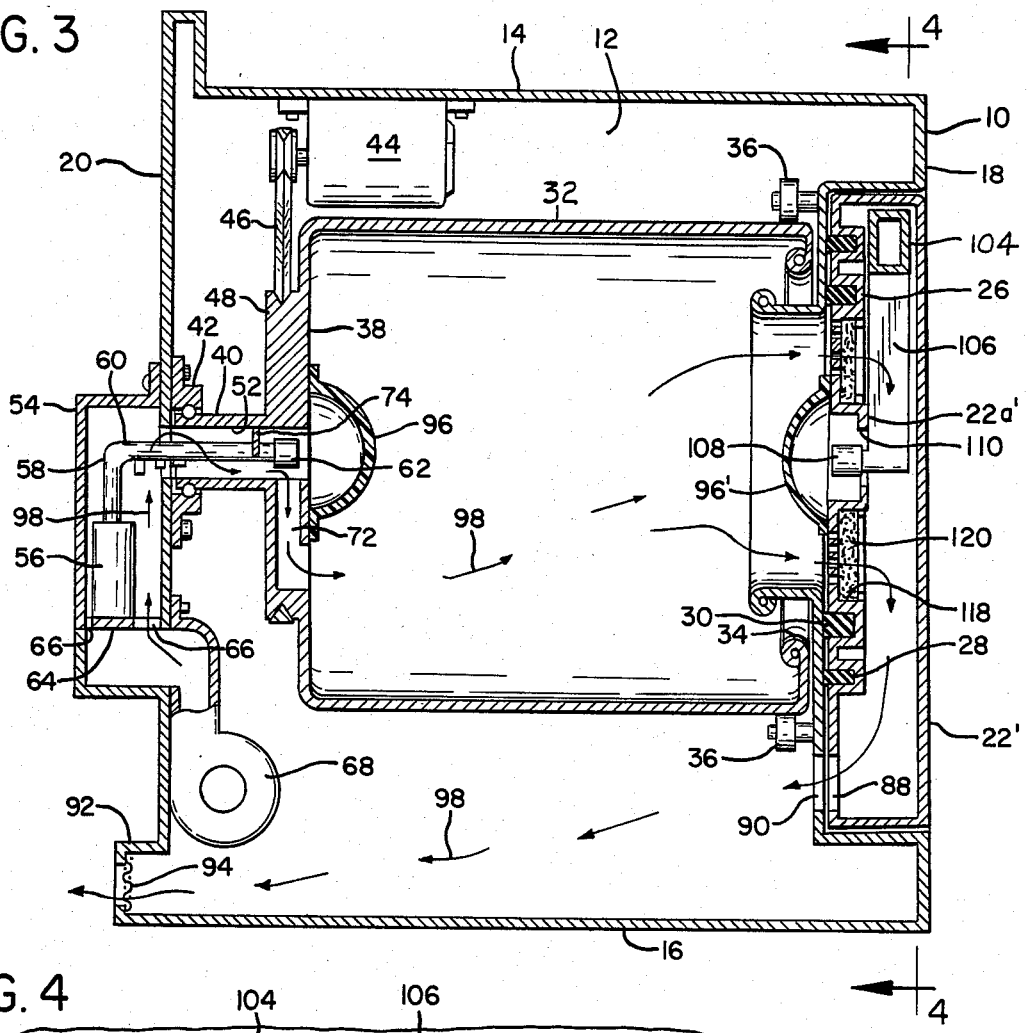
FIG. 3 is a sectional view similar to FIG. 2 but showing a modification of the invention.
Figure 4:
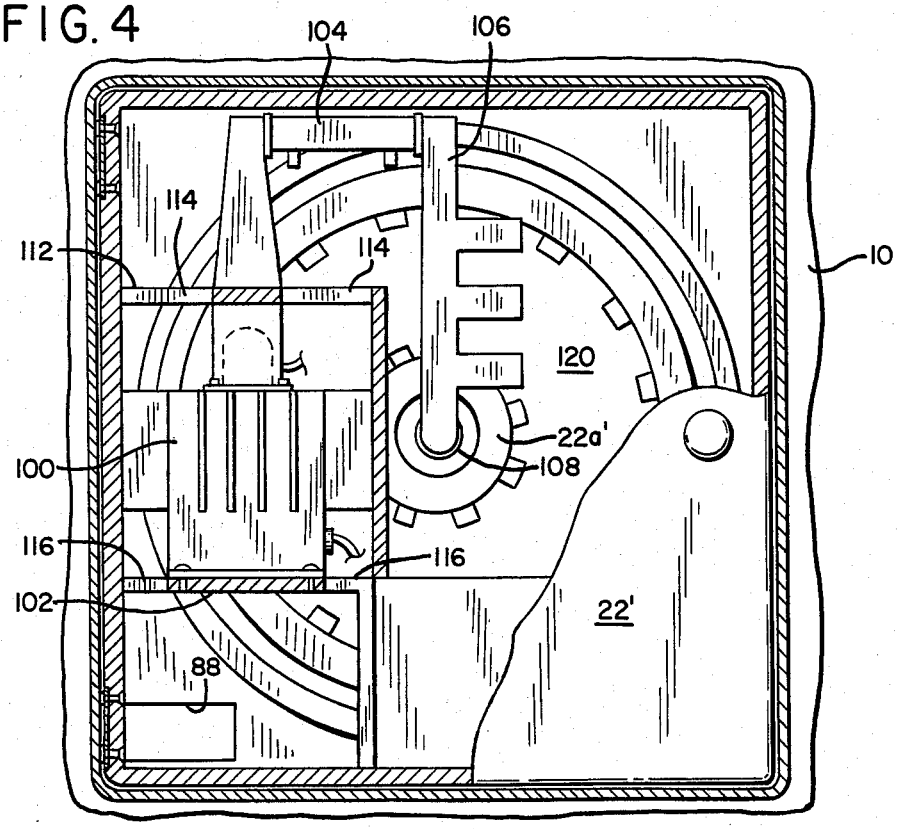
FIG. 4 is a face view with parts broken away, this view being taken on line 4—4 of FIG. 3.

FIGS. 3 and 4 show a modification of the invention illustrating a concept of the invention which employs both front and rear power means. The rear power means and associated structure are the same as described in connection with the first embodiment. As to the front power means, the door 22' and its inner wall 22*a'* in this second embodiment are sufficiently spaced to support power means 100 therein. Such power means is supported on an elevated cross web 102 and has a directional coupler portion 104, a tuner portion 106, and an output or wave guide portion 108, the output portion 108 projecting through an opening 110 in the rear wall portion 22*a'* of the door and being associated with a dome-like shield 96' as in the rear power means. The microwave power means 100 is contained in a housing 112 having upper inlet openings 114 communicating with the interior or cavity of the drum and lower outlet openings 116.

The inner wall 22*a'* of the door has an annular recess 118 for removably holding an annular lint basket 120 which similar to the first embodiment is of suitable material and mesh to filter both lint and microwave energy.

In the operation of the blower 68, air flows, as shown by arrows 98 in FIG. 3, past the first power means 56 and then through the drum. It then flows through lint basket 120 and around the second power means, and out the outlet.

The embodiment of FIGS. 3 and 4 provides a double powered unit and with suitable controls, not shown, one or both of such units may be used. Both power units are cooled by a common forced air means, although it is to be understood that additional forced air means may be provided in association with the front power means if desired.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. Microwave drying mechanism for removing moisture from articles comprising a housing including front and rear portions, a hollow tumbler-type microwave opaque drum having a front loading opening, a rear wall, and an inner cavity arranged to receive articles from which moisture is to be removed, said housing also having a front opening for access to said drum opening, support means rotatably supporting said drum on substantially a horizontal axis, drive means arranged to rotate said drum whereby articles being dried tumble laterally across the interior of said drum, first microwave power means disposed with the output thereof directed into the rear of said cavity for applying its radiation energy to tumbling articles in said drum, a door on said housing at said housing opening, second microwave power means mounted on said door and disposed with the output thereof directed into the front of said cavity for applying its radiation energy to tumbling articles in said drum, an electric circuit for said power means, control means in said circuit for said power means, auxiliary housing means enclosing said first microwave power means and auxiliary housing means enclosing said second microwave power means, and forced air means directed into said auxiliary housing means from the rear of said housing to flow along said first power means, then through said cavity, and then along said second power means whereby to cool both said power means and also to remove moisture.

2. Microwave drying mechanism for removing moisture from articles comprising a housing including front and rear portions, a hollow tumbler-type microwave opaque drum having a front loading opening, a rear wall, and an inner cavity arranged to receive articles from which moisture is to be removed, said housing also having a front opening for access to said drum opening, support means rotatably supporting said drum adjacent the front thereof on substantially a horizontal access, a rearwardly extending integral hub on the rear wall of said drum, bearing means on said housing rotatably supporting said hub and providing rotatable support of said drum at the rear, drive means arranged to rotate said drum whereby articles being dried tumble laterally across the interior of said drum, said rear wall having an opening and said hub having an axial bore communicating with said rear wall opening, microwave power means disposed with the output thereof directed through said rear wall opening and through the bore of said hub into the rear of said cavity for applying its radiation energy to articles tumbling laterally across said rotating drum for removing moisture therefrom, an electric circuit for said power means, and control means in said circuit for said power means.

3. The microwave drying mechanism of claim 2 including a microwave transparent dome-like shield mounted on said rear wall over said rear wall opening to keep tumbling articles out of the near field of said microwave output.

4. The microwave drying mechanism of claim 2 including a microwave transparent dome-like shield mounted on said rear wall over said rear wall opening to keep tumbling articles out of the near field of said microwave output, auxiliary housing means enclosing said microwave power means, forced air means directed into said auxiliary housing means from the rear of said housing to flow along said rear power means and through said axial bore, and bypass passageway means in said rear wall leading radially from said axial bore and exiting radially outwardly said shield.

* * * * *